US009234161B2

(12) United States Patent
Eiting et al.

(10) Patent No.: US 9,234,161 B2
(45) Date of Patent: Jan. 12, 2016

(54) SURFACTANT COMBINATION FOR IMPROVED DRYING

(71) Applicant: Henkel AG & Co. KGaA, Duesseldorf (DE)

(72) Inventors: Thomas Eiting, Duesseldorf (DE); Nina Mussmann, Willich (DE); Thorsten Bastigkeit, Wuppertal (DE); Konstantin Benda, Mettmann (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/737,068

(22) Filed: Jun. 11, 2015

(65) Prior Publication Data

US 2015/0275137 A1 Oct. 1, 2015

Related U.S. Application Data

(63) Continuation of application No. PCT/EP2013/076119, filed on Dec. 10, 2013.

(30) Foreign Application Priority Data

Dec. 17, 2012 (DE) ..... 10 2012 223 339

(51) Int. Cl.

| | |
|---|---|
| ***C11D 1/72*** | (2006.01) |
| ***C11D 1/722*** | (2006.01) |
| ***C11D 1/825*** | (2006.01) |
| ***B08B 3/04*** | (2006.01) |
| ***A47L 15/00*** | (2006.01) |

(52) U.S. Cl.
CPC ..... *C11D 1/8255* (2013.01); *A47L 15/00* (2013.01); *B08B 3/04* (2013.01)

(58) Field of Classification Search
CPC ..... C11D 1/72; C11D 1/721; C11D 1/722; C11D 1/825; C11D 1/8255
See application file for complete search history.

(56) References Cited

U.S. PATENT DOCUMENTS

| | | | | |
|---|---|---|---|---|
| 5,536,438 | A * | 7/1996 | Scialla et al. | C11D 3/3947 510/238 |
| 7,871,971 | B1 | 1/2011 | Koester et al. | |
| 8,148,313 | B2 | 4/2012 | Alexandre et al. | |
| 8,349,784 | B2 | 1/2013 | Zipfel et al. | |
| 2010/0305018 | A1 | 12/2010 | Bittner et al. | |

FOREIGN PATENT DOCUMENTS

WO 2011/151188 A1 12/2011

OTHER PUBLICATIONS

PCT International Search Report (PCT/EP2013/076119) dated Nov. 3, 2014.

* cited by examiner

*Primary Examiner* — Brian P Mruk
(74) *Attorney, Agent, or Firm* — Thomas G. Krivulka

(57) ABSTRACT

The present invention describes a dishwashing detergent containing at least four special nonionic surfactants for improving the drying of plastic wash ware. The invention further relates to the use of the dishwashing detergent in an automatic dishwashing method and to the use of the dishwashing detergent to improve the drying of plastic wash ware.

10 Claims, No Drawings

SURFACTANT COMBINATION FOR IMPROVED DRYING

FIELD OF THE INVENTION

The present invention generally relates to a dishwashing detergent containing a combination of different nonionic surfactants, an automatic dishwashing method using this dishwashing detergent, and the use of this dishwashing detergent for improving the drying in automatic dishwashing.

BACKGROUND OF THE INVENTION

Dishwashing detergents are available to the consumer in a variety of product forms. Apart from the traditional liquid hand dishwashing detergents, automatic dishwashing detergents in particular have become very important as household dishwashers have become more common. These automatic dishwashing detergents are typically offered to the consumer in solid form, for example, as a powder or as a tablet, but increasingly also in liquid form.

An objective of manufacturers of automatic dishwashing detergents is the constant improvement of the cleaning performance of these agents, wherein typically specific surfactants are used such as, for example, nonionic surfactants. For ecological and economic reasons, in recent times the consumer has additionally been paying more attention to the cleaning performance in low-temperature cleaning cycles, short cleaning cycles, and/or cleaning cycles with a reduced water consumption.

These developments, however, often have the result that the wash ware are not dried sufficiently after the rinse cycle and the consumer must dry them afterwards by hand, which is not very consumer-friendly.

WO 2011/151188 A1 discloses an automatic dishwashing detergent that contains the combination of a nonionic surfactant and polyvinylpyrrolidone particles and results in improvement in the cleaning performance and drying.

In EP 2 358 853 it was possible to observe an improvement in the cleaning and rinsing performance and improved drying of the wash ware by the combination of two nonionic surfactants with an anionic copolymer.

Although advances could be made in drying performance by the objects of the aforementioned publications, to dry wash ware, especially plastic, the consumer must still often dry by hand afterwards.

The object of the present invention was to provide a dishwashing detergent that results in improved drying of the wash ware, particularly of plastic wash ware.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Dishwashing detergent, characterized in that it contains at least four nonionic surfactants A, B, C, and D, wherein surfactant A is described by the general formula $R^1O(AlkO)_xM(OAlk)_yOR^2$, wherein $R^1$ and $R^2$ independently of one another stand for a branched or unbranched, saturated or unsaturated, optionally hydroxylated alkyl group having 4 to 22 carbon atoms, Alk stands for a branched or unbranched alkyl group having 2 to 4 carbon atoms, x and y independently of one another stand for values between 1 and 70, and M stands for an alkyl group from the group $CH_2$, $CHR^3$, $CR^3R^4$, $CH_2CHR^3$, and $CHR^3CHR^4$, wherein $R^3$ and $R^4$ independently of one another stand for a branched or unbranched, saturated or unsaturated, cyclic or acyclic alkyl or alkenyl group having 1 to 18 carbon atoms; surfactants B and C, which are different, are both described by the general formula $R^1O[CH_2CH(CH_3)O]_x[CH_2CH_2O]_y[CH_2CH(CH_3)O]_zCH_2CH(OH)R^2$, in which $R^1$ stands for a linear or branched aliphatic hydrocarbon group having 4 to 22 carbon atoms, $R^2$ denotes a linear or branched hydrocarbon group having 2 to 26 carbon atoms, x and z stand for values between 0 and 40, and y stands for a value of at least 15; and surfactant D is described by the general formula $R^1O[CH_2CH(R^3)O]_x[CH_2CHO]_y[CH_2CH(R^4)O]_zC(O)R^2$, wherein $R^1$ stands for a branched or unbranched alkyl group having 8 to 16 carbon atoms, $R^3$ and $R^4$ independently of one another stand for hydrogen or a branched or unbranched alkyl group having 1 to 5 carbon atoms, $R^2$ stands for an unbranched alkyl group having 5 to 17 carbon atoms, x and z independently of one another stand for a value from 1 to 5, and y stands for a value from 13 to 35.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the present invention is achieved by a dishwashing detergent containing at least four nonionic surfactants A, B, C, and D, wherein I. surfactant A is described by the general formula $R^1O(AlkO)_xM(OAlk)_yOR^2$, wherein

- $R^1$ and $R^2$ independently of one another stand for a branched or unbranched, saturated or unsaturated, optionally hydroxylated alkyl group having 4 to 22 carbon atoms,
- Alk stands for a branched or unbranched alkyl group having 2 to 4 carbon atoms,
- x and y independently of one another stand for values between 1 and 70, and
- M stands for an alkyl group from the group $CH_2$, $CHR^3$, $CR^3R^4$, $CH_2CHR^3$, and $CHR^3CHR^4$, wherein $R^3$ and $R^4$ independently of one another stand for a branched or unbranched, saturated or unsaturated, cyclic or acyclic alkyl or alkenyl group having 1 to 18 carbon atoms;

II. surfactants B and C, which are different, are both described by the general formula $R^1O[CH_2CH(CH_3)O]_x[CH_2CH_2O]_y[CH_2CH(CH_3)O]_zCH_2CH(OH)R^2$, in which

- $R^1$ stands for a linear or branched aliphatic hydrocarbon group having 4 to 22 carbon atoms,
- $R^2$ denotes a linear or branched hydrocarbon group having 2 to 26 carbon atoms,
- x and z stand for values between 0 and 40, and
- y stands for a value of at least 15; and III. surfactant D is described by the general formula $R^1O[CH_2CH(R^3)O]_x[CH_2CHO]_y[CH_2CH(R^4)O]_zC(O)R^2$, wherein

- $R^1$ stands for a branched or unbranched alkyl group having 8 to 16 carbon atoms,
- $R^3$ and $R^4$ independently of one another stand for hydrogen or a branched or unbranched alkyl group having 1 to 5 carbon atoms,
- $R^2$ stands for an unbranched alkyl group having 5 to 17 carbon atoms, x and z independently of one another stand for a value from 1 to 5, and y stands for a value from 13 to 35.

It was now surprisingly found that a dishwashing detergent containing at least four different specific nonionic surfactants results in a more complete drying of the wash ware in an automatic dishwashing method.

It is preferred in this case that the dishwashing detergent contains as a nonionic surfactant A a surfactant of the general formula $R^1$—CH(OH)$CH_2$—O$(CH_2CH_2O)_xCH_2CHR(OCH_2CH_2)_yO$—$CH_2CH(OH)$—$R^2$, in which $R^1$ and $R^2$ independently of one another stand for an alkyl group or alkenyl group having 6 to 16 carbon atoms, and R stands for a linear, saturated alkyl group having 2 to 12 carbon atoms, preferably 4 to 10 carbon atoms, and x and y independently of one another have values from 5 to 20.

It is also preferred that the dishwashing detergent has the nonionic surfactants B and C of the general formula $R^1O[CH_2CH_2O]yCH_2CH(OH)R^2$, in which $R^1$ stands for a linear or branched aliphatic hydrocarbon group having 4 to 22 carbon atoms, $R^2$ denotes a linear or branched hydrocarbon group having 2 to 26 carbon atoms, and y stands for a value between 15 and 120, preferably 20 to 100, and especially 20 to 80.

In this case, it is especially preferred that the nonionic surfactants B and C are selected from the group of hydroxy mixed ethers of the general formula $C_{4-22}$—CH(OH)$CH_2$O-$(EO)_{20-120}$—$C_{2-26}$, for example, $C_{8-12}$ fatty alcohol-$(EO)_{22}$-2-hydroxydecyl ethers and $C_{4-22}$ fatty alcohol-$(EO)_{40-80}$-2-hydroxyalkyl ethers.

It is preferred, moreover, that a surfactant of the general formula $R^1O[CH_2CH(R^3)O]_x[CH_2CHO]_y[CH_2CH(R^4)O]_zC(O)R^2$ is used as nonionic surfactant D in the dishwashing detergent, wherein $R^1$ stands for a branched or unbranched alkyl group having 10 to 15 carbon atoms, $R^3$ and $R^4$ independently of one another stand for hydrogen or a branched or unbranched alkyl group having 2 or 3 carbon atoms, $R^2$ stands for an unbranched alkyl group having 8 to 16 carbon atoms, x and z independently of one another stand for a value from 1 to 5, and y stands for a value from 20 to 30.

In a preferred embodiment, the dishwashing detergent contains 0.1 to 10% by weight, preferably 0.5 to 7% by weight, and especially preferably 1 to 5% by weight of surfactant A, 0.1 to 10% by weight, preferably 0.5 to 7% by weight, and especially preferably 1 to 5% by weight of surfactant B, 0.1 to 10% by weight, preferably 0.5 to 7% by weight, and especially preferably 1 to 5% by weight of surfactant C, and 0.1 to 10% by weight, preferably 0.5 to 7% by weight, and especially preferably 1 to 5% by weight of surfactant D.

A further object of the invention is a method for cleaning dishware in a dishwasher using a specific dishwashing detergent.

A preferred embodiment of the invention concerns a dishwashing method that is carried out at a liquor temperature below 60° C., preferably not above 50° C.

A reduced liquor temperature is expressly desired by the consumer from the economic and ecological standpoint.

A further object of the invention is the use of a dishwashing detergent for improving the drying of plastic wash ware in automatic dishwashing.

When the specific dishwashing detergent is used, significantly fewer water residues are observed on the surface of the plastic wash ware after drying of plastic wash ware.

The invention will be described in greater detail below, inter alia, on the basis of examples.

The specific dishwashing detergent is preferably an automatic dishwashing detergent.

Compositions that can be used for cleaning dirty dishware in a dishwashing method are designated in this application as a dishwashing detergent, preferably an automatic dishwashing detergent. Thereby, the specific dishwashing detergents differ, for example, from so-called rinse aids which can be used in combination with dishwashing detergents and exert no cleaning effect of their own.

The dishwashing detergent contains as a component a nonionic surfactant A of the general formula $R^1O(AlkO)_xM(OAlk)_yOR^2$, wherein $R^1$ and $R^2$ independently of one another stand for a branched or unbranched, saturated or unsaturated, optionally hydroxylated alkyl group having 4 to 22 carbon atoms, Alk stands for a branched or unbranched alkyl group having 2 to 4 carbon atoms, x and y independently of one another stand for values between 1 and 70, and M stands for an alkyl group from the group $CH_2$, $CHR^3$, $CR^3R^4$, $CH_2CHR^3$, and $CHR^3CHR^4$, wherein $R^3$ and $R^4$ independently of one another stand for a branched or unbranched, saturated or unsaturated, cyclic or acyclic alkyl or alkenyl group having 1 to 18 carbon atoms.

In a preferred embodiment, the dishwashing detergent contains as the nonionic surfactant A a surfactant of the general formula $R^1$—CH(OH)$CH_2$—O$(CH_2CH_2O)_xCH_2CHR(OCH_2CH_2)_yO$—$CH_2CH(OH)$—$R^2$, in which $R^1$ and $R^2$ independently of one another stand for an alkyl group or alkenyl group having 6 to 16 carbon atoms, and R stands for a linear, saturated alkyl group having 2 to 12 carbon atoms, preferably 4 to 10 carbon atoms, and x and y independently of one another have values from 5 to 20.

In a possible embodiment, surfactant A can comprise, for example, Dehypon® DA (from BASF), wherein surfactant A is not limited in any way thereto.

The nonionic surfactant A is preferably used in amounts of 0.1 to 10% by weight, more preferably in amounts of 0.5 to 7% by weight, and especially in amounts of 1 to 5% by weight in the dishwashing detergent, the percentage by weight being based on the total agent.

The dishwashing detergent contains as further components the nonionic surfactants B and C which are different and are both described by the general formula $R^1O[CH_2CH(CH_3)O]_x[CH_2CH_2O]_y[CH_2CH(CH_3)O]_zCH_2CH(OH)R^2$, in which $R^1$ stands for a linear or branched aliphatic hydrocarbon group having 4 to 22 carbon atoms, $R^2$ denotes a linear or branched hydrocarbon group having 2 to 26 carbon atoms, x and z stand for values between 0 and 40, and y stands for a value of at least 15.

In a preferred embodiment, the dishwashing detergent contains the nonionic surfactants B and C which have the general formula $R^1O[CH_2CH_2O]_yCH_2CH(OH)R^2$, in which $R^1$ stands for a linear or branched aliphatic hydrocarbon group having 4 to 22 carbon atoms, $R^2$ denotes a linear or branched hydrocarbon group having 2 to 26 carbon atoms, and y stands for a value between 15 and 120, preferably 20 to 100, and especially 20 to 80.

Especially preferred in this case is a dishwashing detergent containing the nonionic surfactants B and C which are selected from the group of hydroxy mixed ethers of the general formula $C_{4-22}$—$CH(OH)CH_2O$-$(EO)_{20-120}$—$C_{2-26}$. Very especially preferably, the agent contains $C_{8-12}$ fatty alcohol-$(EO)_{22}$-2-hydroxydecyl ethers and $C_{4-22}$ fatty alcohol-$(EO)_{40-80}$-2-hydroxyalkyl ethers as surfactants B and C. In a possible embodiment, surfactant B can comprise, for example, Dehypon® E127 (from BASF) and surfactant C Dehypon® GRA (from BASF), wherein neither surfactant B nor surfactant C is limited in any way thereto.

The nonionic surfactants B and C are each used preferably in amounts of 0.1 to 10% by weight, more preferably in amounts of 0.5 to 7% by weight, and especially in amounts of 1 to 5% by weight in the dishwashing detergent, the percentage by weight being based on the total agent.

The dishwashing detergent contains as a further component the nonionic surfactant D which is described by the general formula $R^1O[CH_2CH(R^3)O]_x[CH_2CHO]_y[CH_2CH(R^4)O]_zC(O)R^2$, wherein $R^1$ stands for a branched or unbranched alkyl group having 8 to 16 carbon atoms, $R^3$ and $R^4$ independently of one another stand for hydrogen or a branched or unbranched alkyl group having 1 to 5 carbon atoms, $R^2$ stands for an unbranched alkyl group having 5 to 17 carbon atoms, x and z independently of one another stand for a value from 1 to 5, and y stands for a value from 13 to 35.

In a preferred embodiment of the invention, the dishwashing detergent contains as the nonionic surfactant D a surfactant of the general formula $R^1O[CH_2CH(R^3)O]_x[CH_2CHO]_y[CH_2CH(R^4)O]_zC(O)R^2$, wherein $R^1$ stands for a branched or unbranched alkyl group having 10 to 15 carbon atoms, $R^3$ and $R^4$ independently of one another stand for hydrogen or a branched or unbranched alkyl group having 2 or 3 carbon atoms, $R^2$ stands for an unbranched alkyl group having 8 to 16 carbon atoms, x and z independently of one another stand for a value from 1 to 5, and y stands for a value from 20 to 30.

In a possible embodiment, surfactant D can comprise, for example, Plurafac® LF 7319 (from BASF), wherein surfactant D is not limited in any way thereto.

The nonionic surfactant D is preferably used in amounts of 0.1 to 10% by weight, more preferably in amounts of 0.5 to 7% by weight, and especially in amounts of 1 to 5% by weight in the dishwashing detergent, the percentage by weight being based on the total agent.

The indicated C chain lengths and degrees of ethoxylation or degrees of alkoxylation of the aforementioned nonionic surfactants represent statistical averages which for a specific product may be an integer or a fractional number. Due to the production methods, commercial products of the aforementioned formulas in most cases do not consist of an individual representative but of mixtures, whereby averages and consequently fractional numbers can result both for the C chain lengths and for the degrees of ethoxylation or degrees of alkoxylation.

The dishwashing detergent can contain, apart from the already mentioned nonionic surfactants, other nonionic surfactants, which can also correspond to one of the general formulas for the nonionic surfactants A to D, but are not limited in any way thereto.

The proportion by weight of the nonionic surfactant in the total weight of the dishwashing detergent in a preferred embodiment is 0.4 to 40% by weight, more preferably 1 to 30% by weight, especially preferably 2 to 20% by weight, and especially 4 to 20% by weight.

The dishwashing detergent can also contain builders in addition to surfactants. Builders are typically substances which contribute to ensuring the cleaning performance of the dishwashing detergent, inter alia, by inhibiting the formation of lime deposits on machine parts and thus enabling an efficient transfer of the energy to the water.

The proportion by weight of builders in the total weight of the dishwashing detergent is preferably 15 to 80% by weight and especially 20 to 70% by weight. Builders include in particular carbonates, phosphates, citrates, and silicates.

The use of carbonate(s) and/or hydrogen carbonate(s), preferably alkali carbonate(s), especially preferably sodium carbonate, is preferably in amounts of 2 to 30% by weight, more preferably 4 to 28% by weight, and especially 8 to 24% by weight, in each case based on the total weight of the dishwashing detergent.

The use of phosphate(s) is preferred furthermore. Of the many commercially available phosphates, alkali metal phosphates have the greatest importance in the detergent and cleaning agent industry, with pentasodium or pentapotassium triphosphate (sodium or potassium tripolyphosphate) being particularly preferred.

Alkali metal phosphate is a collective term for the alkali metal (particularly sodium and potassium) salts of the various phosphoric acids, it being possible to distinguish metaphosphoric acids $(HPO_3)_n$ and orthophosphoric acid $H_3PO_4$ in addition to higher-molecular weight representatives. The phosphates combine several advantages in themselves: They act as alkali carriers, prevent lime deposits on machine parts or lime incrustations on the items to be cleaned, and moreover contribute to the cleaning performance.

Especially preferred phosphates are pentasodium triphosphate, $Na_5P_3O_{10}$ (sodium tripolyphosphate), and the corresponding potassium salt pentapotassium triphosphate, $K_5P_3O_{10}$ (potassium tripolyphosphate). Furthermore, sodium potassium tripolyphosphates are preferably used.

If within the scope of the present application phosphates are used as builders in the dishwashing detergent, this detergent contains phosphate(s), preferably alkali metal phosphate(s), especially preferably pentasodium or pentapotassium triphosphate (sodium or potassium tripolyphosphate), in amounts of 5 to 70% by weight, preferably 15 to 55% by weight, and especially 20 to 50% by weight, in each case based on the total weight of the dishwashing detergent.

Polycarboxylates/polycarboxylic acids, polymeric carboxylates, aspartic acid, polyacetals, and dextrins are also used as preferred builders. This class of substances is also called organic cobuilders and described below.

If a polycarboxylic acid is used as the builder, it can be used in the form of the free acid and/or the alkali salts thereof, particularly sodium salts, wherein a polycarboxylic acid is understood to be a carboxylic acid that carries more than one acid function. Citric acid, adipic acid, succinic acid, glutaric acid, malic acid, tartaric acid, maleic acid, fumaric acid, sugar acids, aminocarboxylic acids, and nitrilotriacetic acid (NTA), provided there are no objections to this type of use for ecological reasons, and mixtures thereof can be cited as examples here. Apart from their builder action, the free acids typically also possess the property of an acidifying component and thus also serve to establish a lower and milder pH value of detergent or cleaning agents.

The dishwashing detergent can contain citrate, preferably sodium citrate, as the builder. The dishwashing detergent can contain preferably 2 to 40% by weight, more preferably 5 to 30% by weight, and especially 7 to 20% by weight of citrate, especially sodium citrate, based on the total weight of the dishwashing detergent.

The citrates are preferably used with carbonates and/or hydrogen carbonates. Preferred dishwashing detergents therefore contain a builder combination of phosphate and carbonate/hydrogen carbonate or of citrate and carbonate/hydrogen carbonate or of phosphate, citrate, and carbonate/hydrogen carbonate.

An especially preferred dishwashing detergent is characterized in that it contains at least two builders from the group of phosphates, carbonates, and citrates, wherein the proportion by weight of these builders, based on the total weight of the dishwashing detergent, is preferably 5 to 80% by weight, more preferably 15 to 75% by weight, and especially 30 to 70% by weight. The combination of two or more builders from the aforementioned group has proven advantageous for the cleaning and rinsing performance of the dishwashing detergent.

Further, polymeric polycarboxylates are suitable as builders. These are, for example, the alkali metal salts of polyacrylic acid or polymethacrylic acid, for example, those with a weight average molecular weight of 500 to 70,000 g/mol.

Suitable polymers are particularly polyacrylates which preferably have a weight average molecular weight of 2000 to 20,000 g/mol. Because of their superior solubility, short-chain polyacrylates that have a weight average molecular weight of 2000 to 10,000 g/mol, and especially preferably of 3000 to 5000 g/mol, may in turn be preferred from this group.

The weight average molecular weights can be determined with the aid of gel permeation chromatography.

The content of (homo)polymeric polycarboxylates in the dishwashing detergent is preferably 0.5 to 20% by weight and especially 3 to 10% by weight.

The dishwashing detergent can contain as a builder crystalline phyllosilicates of the general formula $$NaMSi_xO_{2x+1}.yH_2O,$$

wherein M represents sodium or hydrogen, x is a number from 1.9 to 22, preferably from 1.9 to 4, especially preferably 2, 3, or 4, and y stands for a number from 0 to 33, preferably from 0 to 20.

Amorphous sodium silicates may also be used which have a $Na_2O:SiO_2$ modulus of 1:2 to 1:3.3, preferably of 1:2 to 1:2.8, and especially of 1:2 to 1:2.6, which preferably have a delayed dissolution and secondary detergent properties.

In a preferred dishwashing detergent, the content of silicates, based on the total weight of the dishwashing detergent, is limited to amounts of 0 to 10% by weight, preferably 0 to 5% by weight, and especially of 0 to 2% by weight. An especially preferred dishwashing detergent is silicate-free.

As a supplement to the aforementioned builders, the dishwashing detergent may contain alkaline agents, preferably alkali metal hydroxides, especially sodium hydroxide. These alkaline agents are used in the dishwashing detergent preferably in amounts of 0 to 10% by weight, more preferably 0 to 5% by weight, especially preferably between 0.1 and 5% by weight, and especially between 0.5 and 5% by weight, in each case based on the total weight of the dishwashing detergent. An alternatively preferred dishwashing detergent is free of alkali metal hydroxides.

The dishwashing detergent may preferably contain enzymes as a further component. These include in particular proteases, amylases, lipases, hemicellulases, cellulases, perhydrolases, or oxidoreductases, and preferably the mixtures thereof. Enzymes may be used in the dishwashing detergent preferably in amounts of 0.0001 to 10% by weight, more preferably 0.01 to 5% by weight, even more preferably 0.1 to 4% by weight, especially preferably between 0.2 and 4% by weight, in each case based on the total weight of the dishwashing detergent.

The dishwashing detergent is preferably a solid dishwashing detergent. A "solid dishwashing detergent" is understood here to be a dishwashing detergent that exists in a solid state of matter at 25° C. and a pressure of 1 bar.

The dishwashing detergent is preferably present in the form of a molded body, particularly a compacted material, above all as a tablet. The molded body can take on any geometric shape such as, for example, concave, convex, biconcave, biconvex, cubic, tetragonal, orthorhombic, cylindrical, spherical, cylindroid, octahedral, conical, pyramidal, ellipsoidal, pentagonal-, heptagonal-, and octagonal-prismatic, and rhombohedral shapes.

The molded body, particularly the tablet, is produced preferably by pressing together particulate starting substances. To produce the tablet, preferably a premix is compacted to form a solid compacted material in a so-called matrix between two dies. This process, which is called tableting for short hereafter, breaks down into four stages: metering, compaction (elastic deformation), plastic deformation, and ejection. The tableting in this case occurs preferably on so-called rotary presses.

The ingredients provided for tableting can be filled into the matrix in the form of a combined particulate premix simultaneously or in the form of individual, separate powders or granules staggered in time or simultaneously, the metering of a prefabricated particulate premix being preferred.

In a further preferred embodiment, the molded body may contain a disintegrant. The action of disintegrants is usually that they increase their volume upon the entry of water, wherein, on the one hand, the intrinsic volume increases (swelling) or, on the other hand, however, due to the release of gases, pressure can also be produced which allows the tablet to break up into smaller particles.

For example, cross-linked polyvinylpyrrolidone (Crospovidone) may be used as a disintegrant, preferably in particulate form.

The dishwashing detergent may contain a disintegrant, especially polyvinylpyrrolidone, preferably in an amount of 0.1 to 5% by weight, particularly in an amount of 0.2 to 3% by weight, primarily in an amount of 0.3 to 1.8% by weight, based on the total weight of the dishwashing detergent.

In addition or alternatively to the polyvinylpyrrolidone particles, the molded bodies may also contain further disintegrants, for example, carbonate/citric acid systems, or carbonate in combination with other organic acids, synthetic polymers or natural polymers, or modified natural substances such as cellulose and starch and the derivatives thereof, as well as alginates or casein derivatives. Furthermore, gas-generating effervescent systems may also be used as further disintegrants. Preferred effervescent systems consist of at least two components that react with one another forming gas, for example, alkali metal carbonate and/or alkali metal hydrogen carbonate and an acidifying agent that is suitable for releasing carbon dioxide from the alkali metal salts in aqueous solution. An acidifying agent that releases carbon dioxide from the alkali salts in aqueous solution is, for example, citric acid.

In an alternative preferred embodiment, however, the molded body may also be present in combination with other product forms, particularly in combination with solid product forms such as powder, granules, or extrudates, or in combination with liquid product forms based on water and/or organic solvents.

The molded body may also be, for example, granules, which are contained in a pouch or a mold.

The simplest realization option in this case are two- or multilayer tablets, wherein each layer of the molded body represents a single phase. The different components, fulfilling the different functions of a dishwashing detergent, preferably can be kept separated from one another by the phase or layered structure so that they cannot enter into undesirable interaction before the wash cycle.

The specific nonionic surfactants A to D may be present in each tablet layer both individually and in any combination. In a preferred embodiment of the invention, certain surfactants or surfactant combinations can be preferred in one of the phases; in a further embodiment of the invention, the surfactants can also be evenly distributed in all phases, however. In a yet further embodiment of the invention, one or more phases of the tablet are completely free of the specific nonionic surfactants A to D.

Therefore, a two- or multiphase tablet is especially preferred, for example, a two-layer tablet, particularly a two-layer tablet with a recess and a molded body located in the recess. Alternatively, however, it can also be preferred to produce a multiphase tablet in which the one phase is integrated in the form of an insertion into the other phase(s).

The dishwashing detergent is preferably preformulated to form dispensing units. These dispensing units preferably comprise the amount of detergent or cleaning-active substances necessary for a cleaning cycle. Preferred dispensing units have a weight between 12 and 30 g, preferably between 14 and 26 g, and especially between 15 and 22 g.

The volume of the aforementioned dispensing units and the spatial shape thereof are selected with particular preference so that a dispensability of the preformulated units is assured by means of the dispensing chamber of the dishwasher. The volume of the dispensing unit therefore is preferably between 10 and 35 ml, primarily between 12 and 30 ml, and especially between 15 and 25 ml.

The dishwashing detergent, particularly the prefabricated dispensing units, in a preferred embodiment can have a water-soluble wrapping.

Apart from the above-described ingredients, the dishwashing detergent can contain further additives such as detergent or cleaning-active substances, preferably from the group of glass corrosion inhibitors, corrosion inhibitors, fragrances, and perfume carriers.

The previously described combinations of ingredients are suitable preferably for the cleaning of dishware in dishwashing methods, particularly in automatic dishwashing methods.

A further object of the present application is an automatic dishwashing method in which the dishwashing detergent is used. In the method for cleaning dishware in a dishwasher using the dishwashing detergent, the dishwashing detergent is preferably dispensed or introduced into the interior of a dishwasher during the running of a dishwashing program, before the start of the main wash cycle or during the main wash cycle. The dispensing or introduction of the dishwashing detergent into the interior of the dishwasher can occur manually, but preferably the dishwashing detergent is dispensed into the interior of the dishwasher by means of the dispensing chamber of the dishwasher. During the cleaning process, preferably no additional water softener and no additional rinse aid are dispensed into the interior of the dishwasher.

A preferred embodiment is an automatic dishwashing method using the preferably solid dishwashing detergent, particularly in the form of an aforementioned molded body, in particular for an improved drying of plastic wash ware.

For economic and ecological reasons, the dishwashing method is preferably carried out at a liquor temperature below 60° C., more preferably not above 50° C., even more preferably at 35 to 45° C. In a preferred embodiment, the dishwashing method lasts 5 to 90 minutes, particularly 10 to 75 minutes, especially preferably 20 to 60 minutes. In alternatively especially preferred embodiments, the dishwashing method lasts at maximum 50, 40, or 30 minutes.

As described above, the dishwashing detergent is distinguished by an improved drying performance in comparison with conventional dishwashing detergents. A further object of the present application, therefore, is the use of a specific dishwashing detergent for improving the drying of plastic wash ware in automatic dishwashing.

EXAMPLES

Example 1

Formulations

TABLE 1

Exemplary formulations for the specific automatic dishwashing detergent tablets. Formulations E1 and E2 correspond to a dishwashing detergent according to the invention; formulations V1 to V3 are comparative examples.

| Ingredient | Formulation E1 [% by weight] | Formulation E2 [% by weight] | Formulation V1 [% by weight] | Formulation V2 [% by weight] | Formulation V3 [% by weight] |
|---|---|---|---|---|---|
| Tripolyphosphate | 32 | 32 | 32 | 32 | 32 |
| (Hydrogen) carbonate | 15 | 15 | 15 | 15 | 15 |
| Enzyme (amylase, protease) | 5 | 5 | 5 | 5 | 5 |
| Nonionic surfactant A | 2 | 2 | 1.99 | 2.5 | 2.03 |
| Nonionic surfactant B | 2 | 2 | 2.43 | 3 | 4.2 |
| Nonionic surfactant C | 2 | 2 | 1.68 | 1.5 | — |
| Nonionic surfactant D | 2 | 1 | — | — | — |
| Additives | to 100 | to 100 | to 100 | to 100 | to 100 |

Example 2

Drying Performance

The drying performance was determined in a Bosch SMS 86M12DE dishwasher using the Eco50 Variospeed program. The water hardness was 21° dH and 50 g of ballast soil was used. Six wash cycles were run, of which the fourth to sixth were used for the evaluation; these were then rated using a scale of 0 to 6. In this case, 0 means that there were no drops on the dishware, 1 means one drop on the dishware, and 6 means six or more drops on the dishware. A significant difference can be seen starting at a score of 0.5.

TABLE 2

Comparison of drying of plastic wash ware during application of the formulations indicated in Table 1 in an automatic dishwasher (Bosch SMS 86M12DE).

| | Plastic | Surfactant amount [% by weight] |
|---|---|---|
| Formulation E1 | 1.1 | 8 |
| Formulation E2 | 1.7 | 7 |
| Formulation V1 | 2.4 | 6 |
| Formulation V2 | 2.7 | 7 |
| Formulation V3 | 2.4 | 6 |

A significant improvement of drying on plastic can be achieved only by the combination of the four specific nonionic surfactants, as in formulations E1 and E2. The comparative formulations V1 to V3, in contrast, show no improved drying performance on plastic wash ware. As the comparison of formulations V1 and V2 shows, a mere increase in the surfactant amount results in a deterioration of the drying. A combination of only two nonionic surfactants, namely, surfactants A and B, with an identical amount of nonionic surfactant, also does not result in an improvement of the drying performance, as could be demonstrated by the tests with formulations V1 and V3. The drying performance could also be improved in addition for glass, porcelain, and steel wash ware.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. Dishwashing detergent, characterized in that it contains at least four nonionic surfactants A, B, C, and D, wherein i. surfactant A is described by the general formula $R^1O(AlkO)_xM(OAlk)_yOR^2$, wherein $R^1$ and $R^2$ independently of one another stand for a branched or unbranched, saturated or unsaturated, optionally hydroxylated alkyl group having 4 to 22 carbon atoms, Alk stands for a branched or unbranched alkyl group having 2 to 4 carbon atoms, x and y independently of one another stand for values between 1 and 70, and M stands for an alkyl group from the group $CH_2$, $CHR^3$, $CR^3R^4$, $CH_2CHR^3$, and $CHR^3CHR^4$, wherein $R^3$ and $R^4$ independently of one another stand for a branched or unbranched, saturated or unsaturated, cyclic or acyclic alkyl or alkenyl group having 1 to 18 carbon atoms;

ii. surfactants B and C, which are different, are both described by the general formula $R^1O[CH_2CH(CH_3)O]_x[CH_2CH_2O]_y[CH_2CH(CH_3)O]_zCH_2CH(OH)R^2$, in which $R^1$ stands for a linear or branched aliphatic hydrocarbon group having 4 to 22 carbon atoms, $R^2$ denotes a linear or branched hydrocarbon group having 2 to 26 carbon atoms, x and z stand for values between 0 and 40, and y stands for a value of at least 15; and iii. surfactant D is described by the general formula $R^1O[CH_2CH(R^3)O]_x[CH_2CHO]_y[CH_2CH(R^4)O]_zC(O)R^2$, wherein $R^1$ stands for a branched or unbranched alkyl group having 8 to 16 carbon atoms, $R^3$ and $R^4$ independently of one another stand for hydrogen or a branched or unbranched alkyl group having 1 to 5 carbon atoms, $R^2$ stands for an unbranched alkyl group having 5 to 17 carbon atoms, x and z independently of one another stand for a value from 1 to 5, and y stands for a value from 13 to 35.

2. Dishwashing detergent according to claim 1, characterized in that it contains as the nonionic surfactant A a surfactant of the general formula $R^1—CH(OH)CH_2—O(CH_2CH_2O)_xCH_2CHR(OCH_2CH_2)_yO—CH_2CH(OH)—R^2$, in which $R^1$ and $R^2$ independently of one another stand for an alkyl group or alkenyl group having 6 to 16 carbon atoms, and R stands for a linear, saturated alkyl group having 2 to 12 carbon atoms, and x and y independently of one another have values from 5 to 20.

3. Dishwashing detergent according to claim 1, characterized in that the nonionic surfactants B and C have the general formula $R^1O[CH_2CH_2O]_yCH_2CH(OH)R^2$, in which $R^1$ stands for a linear or branched aliphatic hydrocarbon group having 4 to 22 carbon atoms, $R^2$ denotes a linear or branched hydrocarbon group having 2 to 26 carbon atoms, and y stands for a value between 15 and 120.

4. Dishwashing detergent according to claim 1, characterized in that the nonionic surfactants B and C are selected from the group of hydroxy mixed ethers of the general formula $C_{4-22}—CH(OH)CH_2O-(EO)_{20-120}—C_{2-26}$.

5. Dishwashing detergent according to claim 1, characterized in that a surfactant of the general formula $R^1O[CH_2CH(R^3)O]_x[CH_2CHO]_y[CH_2CH(R^4)O]_zC(O)R^2$ is used as nonionic surfactant D, wherein $R^1$ stands for a branched or unbranched alkyl group having 10 to 15 carbon atoms, $R^3$ and $R^4$ independently of one another stand for hydrogen or a branched or unbranched alkyl group having 2 or 3 carbon atoms, $R^2$ stands for an unbranched alkyl group having 8 to 16 carbon atoms, x and z independently of one another stand for a value from 1 to 5, and y for a value from 20 to 30.

6. Dishwashing detergent according to claim 1, containing 0.1 to 10% by weight of surfactant A, 0.1 to 10% by weight of surfactant B, 0.1 to 10% by weight of surfactant C, and 0.1 to 10% by weight of surfactant D.

7. Method for cleaning dishware in a dishwasher wherein a dishwashing detergent according to claim 1 is contacted with dishware in a wash liquor.

8. Method according to claim 7, characterized in that the dishwashing method is carried out at a liquor temperature below 60° C.

9. Dishwashing detergent according to claim 3, characterized in that the nonionic surfactants B and C have the general formula $R^1O[CH_2CH_2O]_yCH_2CH(OH)\ R^2$, in which $R^1$ stands for a linear or branched aliphatic hydrocarbon group having 4 to 22 carbon atoms, $R^2$ denotes a linear or branched hydrocarbon group having 2 to 26 carbon atoms, and y stands for a value between 20 and 100.

10. Dishwashing detergent according to claim 4, characterized in that the nonionic surfactants B and C are selected from the group of $C_{8-12}$ fatty alcohol-$(EO)_{22}$-2-hydroxydecyl ethers and $C_{4-22}$ fatty alcohol-$(EO)_{40-80}$-2-hydroxyalkyl ethers.

* * * * *